US005972855A

United States Patent [19]

Honary

[11] Patent Number: 5,972,855

[45] Date of Patent: Oct. 26, 1999

[54] SOYBEAN BASED HYDRAULIC FLUID

[76] Inventor: Lou A. T. Honary, 2612 Minnetonka Dr., Cedar Falls, Iowa 50613

[21] Appl. No.: 08/947,458

[22] Filed: Oct. 14, 1997

[51] Int. Cl.[6] ..... C10M 105/32; C10M 171/00

[52] U.S. Cl. ..... 508/491; 252/73; 508/305; 508/510

[58] Field of Search ..... 508/491

[56] References Cited

U.S. PATENT DOCUMENTS

| | | | |
|---|---|---|---|
| 2,090,263 | 8/1937 | Moses | 508/130 |
| 2,339,798 | 1/1944 | Musher | 508/442 |
| 4,783,274 | 11/1988 | Jokinen et al. | 508/209 |
| 5,300,242 | 4/1994 | Nichols et al. | 508/491 |
| 5,338,471 | 8/1994 | Lal | 508/186 |
| 5,358,652 | 10/1994 | MacPherson | 508/271 |
| 5,380,469 | 1/1995 | Flider | 508/486 |
| 5,413,725 | 5/1995 | Lal et al. | 508/235 |
| 5,427,700 | 6/1995 | Stoffa | 508/491 |
| 5,427,704 | 6/1995 | Lawate | 508/491 |
| 5,451,334 | 9/1995 | Bongardt et al. | 508/307 |
| 5,454,965 | 10/1995 | Shanahan et al. | 508/486 |
| 5,538,654 | 7/1996 | Lawate et al. | 508/308 |
| 5,567,345 | 10/1996 | Landis | 508/486 |
| 5,595,965 | 1/1997 | Wiggins | 508/491 |

OTHER PUBLICATIONS

SAE Technical Papers Series, "Potential Utilization of Soybean Oil as an Industrial Hydraulic Oil" by Lou A. T. Honary, Sep. 1994.

SAE Technical Paper Series, "Performance of Selected Vegetable Oils in ASTM Hydraulic Tests" by Lou Honary, Sep. 1995.

SAE Technical Paper Series, "A Market Research and Analysis Report on Vegetable–Based Industrial Lubricants" by Ronald A. Padavich and Lou Honary, Sep. 1995.

Fluid Power Journal, "Soybean Oil as an Alternative Hydraulic Fluid?" by Dr. Lou A. T. Honary, Sep./Oct. 1994.

Plant Engineering, "Hydraulic Fluid Choices" by Joseph L. Foszcz, Apr. 1996, pp. 68–72.

Bioresource Technology, "An Investigation of the Use of Soybean Oil in Hydraulic Systems" by Lou A. T. Honary, 1996, pp. 41–47.

Lubrizol 9999 product brochure, Apr. 1993.

Cargill Foods Winterized Soybean Salad Oil product brochure, Aug. 1996.

*Primary Examiner*—Ellen M. McAvoy
*Attorney, Agent, or Firm*—Glenn Johnson

[57] ABSTRACT

A soybean oil based hydraulic fluid of which the soybean oil is less than 85% by weight and the fatty acid profile of the hydraulic fluid includes about 0.12% C24:0. The base oil is hydrogenated to produce maximum possible stability of the soybean oil, and is winterized to remove crystallized fats and improve the pour point of the base oil without the necessity of heating the oil. The base oil is then combined with a hydrocarbon based additive package containing materials specifically designed for mobile equipment application including friction and anti-chatter materials, needed for wet clutches and brakes.

10 Claims, 5 Drawing Sheets

BIODEGRADATION OF PARTIALLY HYDROGENATED SOY OIL WITH 200 PPM TBHQ (BASE OIL) MEASURED AS $CO_2$ PRODUCTION PER UNIT AMOUNT OF SOIL

BIODEGRADATION OF SOY-BASED LUBRICANT AS MEASURED BY $CO_2$ PRODUCTION PER AMOUNT OF SOIL

BIODEGRADATION IN SOIL AS MEASURED AS $CO_2$ PRODUCTION PER UNIT AMOUNT OF SOIL

SOYBEAN BASED HYDRAULIC FLUID

BACKGROUND OF THE INVENTION

With the advent of mechanized society within the United States and around the world, the need for lubrication and hydraulic fluids has been ever increasing. A finite supply of petroleum based products plus concerns over environmental effects from spills/disposal of petroleum based lubricants has fueled interest in the use of vegetable oils as viable substitutes.

Efforts in use of vegetable oils as the base oil have focused upon less stringent uses such as hydraulic fluids, transmission fluids, and greases and not on the more severe automotive-type (engine) lubricants. The vast majority of these endeavors have utilized vegetable oils high in natural oleic acid levels such as safflower oil and rapeseed oil. The reason for this focused research upon these high oleic acid level vegetable oils is the tendency of natural vegetable oils to destabilize in use absent the presence of a high level of oleic acid. Soybean oils have a low level of oleic acid and been uniformly rejected in practical application because of the tendency of soybean oil to solidify while in use within the environment of the machinery.

The primary purpose of hydraulic fluids is to maintain lubrication and fluid characteristics while in use within the system so as to maintain appropriate pressure to operate hydraulic actuators (cylinders/motors) assemblies in machinery on demand. In order for appropriate pressures to be maintained within a hydraulic system, the fluid is constantly being run through a pump. The constant pumping action creates a substantial build up of heat in use, which the vegetable-based hydraulic fluid must withstand. Additionally, the operation of the hydraulic actuators and the process of constantly pumping the vegetable-based hydraulic fluid subjects the fluid to constant mechanical stresses. Vegetable oil based hydraulic fluids have found commercial success in certain industrial applications. These applications present a much less demanding environment in which the vegetable oil based hydraulic fluid must function. Specifically, the industrial applications present an environment where the hydraulic fluid is cooled so as to control and maintain a relatively stable temperature. Variations in temperature, in particular high temperature environments, are known to impact the ability of a vegetable oil based fluid to remain in the liquid state. As a result, this limited application within the industrial setting has been an area in which vegetable oil based hydraulic fluids have been found to function with relative success, and represents the vast majority of commercial settings in which vegetable oil based hydraulic fluids are found in use at the present time.

Use of vegetable oil based hydraulic fluids in the out-of-doors environment presents a much harsher challenge. To date, the success of such fluids has been very limited. Rapeseed oil based hydraulic fluids recently have been commercially offered, but questions remain as to the functionality of these hydraulic fluids in the out-of-doors environment, particularly within mobile equipment.

A use presenting the harshest conditions for hydraulic fluids is within agricultural tractors. Tractors are required to function in all temperature conditions, performing a variety of mechanical operations. In use, tractor hydraulic fluid must successfully operate not only the actuators of the hydraulic system, but must also work well within the brake assembly.

The key characteristics required for mobile hydraulic fluid use are:

1. High oxidation stability
   - for long life and protection
   - small sump capacity
   - high temperatures (170° C.)
   - air entrainment
   - reduced flow rates
   - increased deposits
2. Viscosity Characteristics
   - low pour point for flow temperature service, particularly during
   - cold starts
   - high Viscosity Index for best viscosity under various operating
   - temperatures
3. Extreme Pressure Performance
   - increased wear protection under heavy and shock loads
   - very high pressures (6,000 to 10,000 psi)
   - material limitations
4. Corrosion Inhibition Properties
   - contaminants in the fluid
   - water
   - oxidation by-products
5. Seal and Polymer Compatibility
   - old and new hoses
   - seal materials
6. Foam Suppressed
   - air entrainment
7. Controlled Friction
   - Operating System Components
   - valves
   - clutches
   - brakes
   - cylinders
   - motors
   - pumps Stationary (indoor) hydraulic systems may not require all of the above properties, although most still apply. The characteristics required in order to operate the braking system involve the normal demands placed upon hydraulic fluid, but also include that the fluid withstand the mechanical sheer forces of dampening the braking action of the assembly. These mechanical sheer forces operate to degrade the hydraulic fluid.

A final demand placed upon tractor hydraulic fluid is the requirement that it function as a transmission fluid. Accordingly, it must withstand greater amounts of heat generated within the operational environment and must have frictional qualities that allow the gears of the transmission to interact. In many instances, these requirements of tractor hydraulic fluid are competing, placing additional demands upon the hydraulic fluid.

Certain of the applications of vegetable oil based hydraulic fluids have resulted in the issuance of patents. One such patent is U.S. Pat. No. 4,783,274. The primary focus of the U.S. Pat. No. 4,783,274 is the use of rapeseed oil as the base component of hydraulic fluid. A review of the data contained within the specification for the patent reveals that none of the bench tests of the subject hydraulic fluid appeared to use any vegetable oil component other than rapeseed oil. Although other oils were included, i.e. olive, peanut, and corn, no mention of soybean was made. Further, the U.S. Pat. No. 4,783,274 covers a hydraulic fluid utilizing vegetable oils comprising 85%–99% of the fluid by weight. As a result, the teachings of the U.S. Pat. No. 4,783,274 are limited to the effectiveness of rapeseed oil based hydraulic fluids within the laboratory environment.

Another prior art patent is U.S. Pat. No. 5,454,965 which is based on utilization of telomerized oil made of about 20% to about 70% of a conjugated triglyceride oil. While the broad description of the triglycerides in this patent may encompass the soybean oil, the U.S. Pat. No. 5,454,965 is mainly concerned with the telomerized triglyceride as a performance enhancing additive for use in industrial lubricants applications. It does not refer to a partial hydrogenation process, nor the specific application for which the present invention is designed.

Another prior art patent, U.S. Pat. No. 5,567,345, is also based on the telomerized oil made up of triglycerides. Again the use of term triglyceride is all encompassing and includes oils such as soybean oil. The telomerized oil described in the U.S. Pat. No. 5,567,345, however, is a blown oil designed to be used as a thickener additive for high viscosity oils in the ranges of 5,000 to 12,000 SUS @ 40° C.

U.S. Pat. No. 5,451,334 is for hydraulic fluid based on rapeseed and soybean oil. The base oil described in this patent is purified rapeseed or soybean oil. While these oils may perform in low demanding industrial stationary equipment, they have not shown to perform in demanding mobile equipment. Hence, a process of hydrogenation is necessary to obtain optimum stability needed for such applications.

Still another prior art patent, U.S. Pat. No. 5,380,469, relates to high viscosity functional fluids prepared by reacting polyglycerol with a triglyceride oil or fat. The patent refers to triglycerides and vegetable oil in an all-encompassing fashion. This patent is, however, specifically concerned with reacting a polyglycerol with a triglyceride oil or fat. Specifically, canola oil is identified as the preferred triglyceride. Furthermore, this patent is concerned with controlled polymerization as a means of increasing the viscosity of the fluid and changing its solubility, and also deals with high viscosity functional lubricants having viscosity ranges of 2,000–2,500 cSt @ 25° C.

In view of the state of the prior art as summarized above, there is a need for an improved non-petroleum based, environmentally safe oil that can be commercially used in the hydraulic systems of mobile outdoor equipment that is operated under widely varying conditions.

SUMMARY OF THE INVENTION

The present invention utilizes a soybean oil based hydraulic fluid in which the soybean oil is less than 85% by weight and the fatty acid profile of the resulting hydraulic fluid includes C24:0. To achieve this result, the base oil is optimized, through the process of hydrogenation, to produce maximum possible stability of the soybean oil. This process is necessary for the mobile outdoor equipment applications. The soybean-based oil of the present invention utilizes an additional step of winterization to remove crystallized fats and improve the pour point of the base oil without the necessity of heating the oil. Finally, the additive package for the present invention contains materials specifically designed for mobile equipment application including friction and anti-chatter materials which are needed for operation of wet clutches and brakes.

This combination of the processed soybean oil and additives thus produces a hydraulic fluid that withstands the rigors of field use involving a wide range of temperatures. The resulting hydraulic oil has a viscosity preferably in the range of 45–50 cSt @ 40° C. vs. prior art soybean based oil which are high viscosity functional lubricants having viscosity ranges of 2,000–2,500 cSt @ 25° C.

DESCRIPTION OF THE PREFERRED EMBODIMENTS OF THE INVENTION

Figure 1:
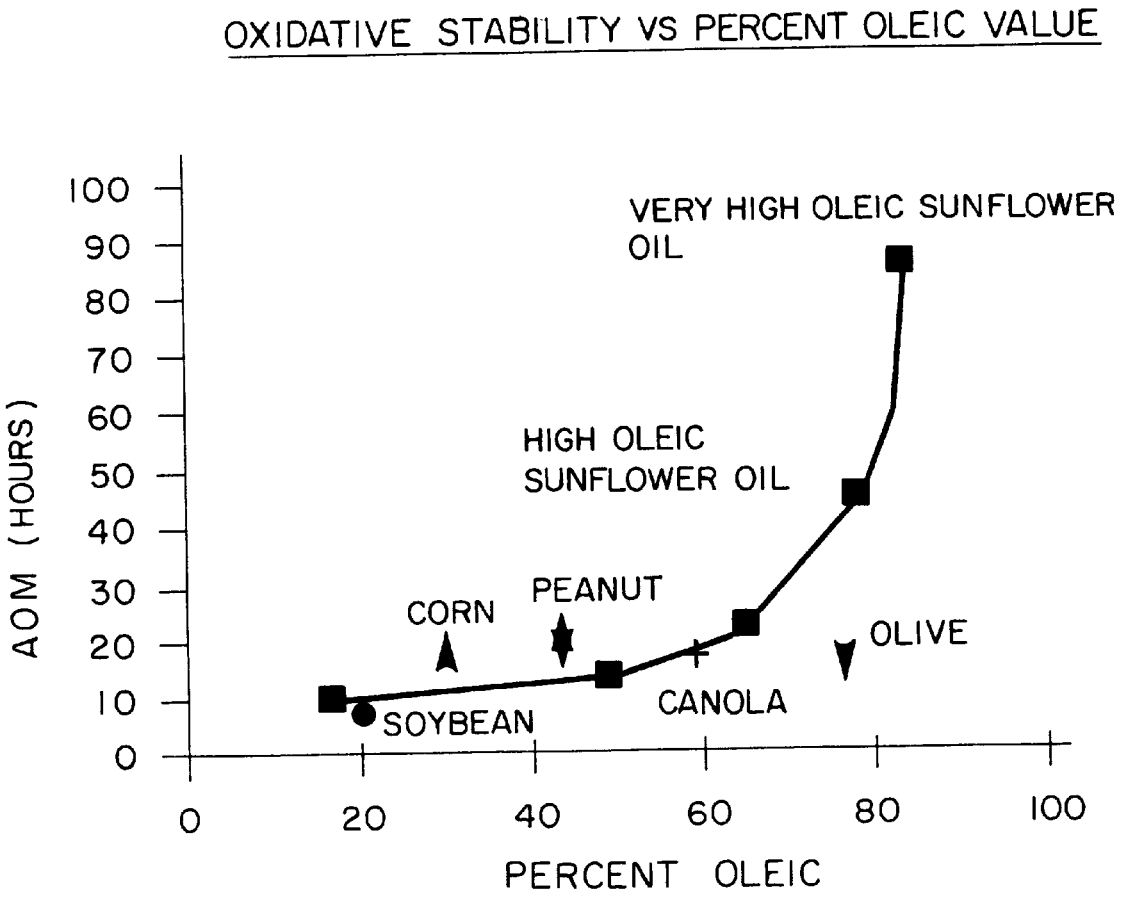
FIG. 1 is a graphic representation showing the Oleic acid content of various vegetable oils plotted against the oxidative stability of said vegetable oils.
Figure 2:
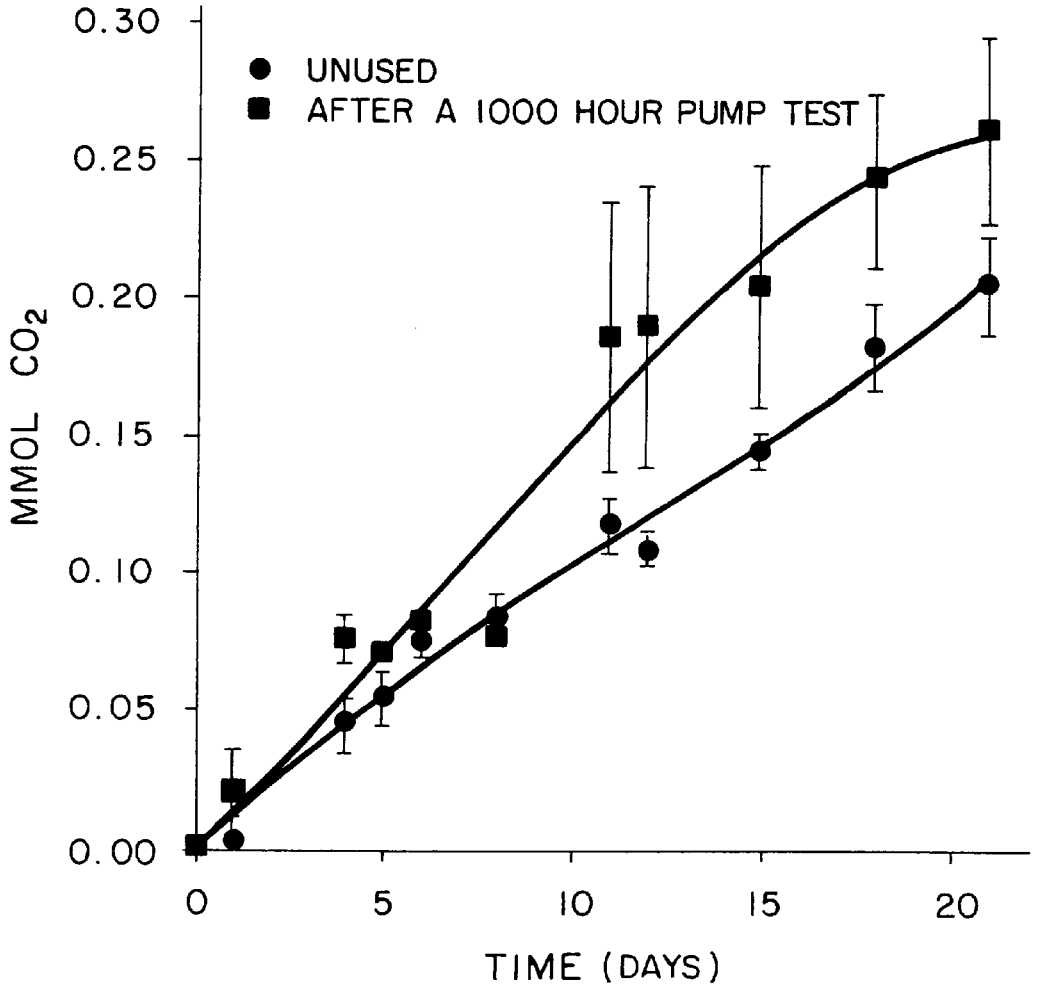
FIG. 2 is a graphic representation demonstrating the biodegradation of the base soybean oil.

Soybean oil based hydraulic fluids were extensively tested under exacting laboratory conditions and in field use. This testing included thousands of hours of hydraulic bench testing. This analysis of soybean oil based hydraulic fluids revealed two primary findings. First, the lubrication qualities associated with the fluid were comparable to the lubrication qualities associated with other vegetable oil based fluids or petroleum based fluids. Second, durability of the fluid was generally a consistent problem with and without the combination of various additives.

In addressing the issue of durability, it was determined that partially hydrogenated soybean oil presented optimal results in bench tests and with field results. Since the demands on the product called for its use in out-of-doors conditions, the soybean oil was winterized to aid its low temperature utility. The winterized, hydrogenated soybean oil which was found to have superior characteristics both in lubrication and durability.

A myriad of additive products were tested in the analysis of soybean oil based hydraulic fluids. The various bench tests and out-of-doors field tests performed on the alternative combinations of additives and soybean oils yielded a wide variety of data. The bench tests provided comparative data in the areas of viscosity, density, pour point, flash point, and acid value. The testing is discussed more fully below.

Test Results for the Invention

Soybean oil in its natural form is oxidatively unstable and when used in hydraulic systems it thickens up. In extreme cases the oil, if left in the hydraulic system, will polymerize. The most common way to determine oxidative stability of vegetable oils has been the Active Oxygen Method (AOM). Recently, however, another method has been introduced using what is called the oxidative stability instrument (OSI). The literature discusses the use of each of these methods. The following table demonstrates a comparison of Canola oil with and without the addition of antioxidants with partially hydrogenated soybean oil using the oxidative stability instrument.

| Oxidation Stability Instrument used in determining Oxidation of Canola and Partially Hydrogenated Soybean Oil | | |
|---|---|---|
| Oil Type | Viscosity (cSt) | OSI Time |
| Canola w. Antioxidant | 38.77 | 39.18 |
| Canola w/o Antioxidant | 38.70 | 9.04 |
| PH Soybean w. Antioxidant | 38.45 | 50.70 |
| PH Soybean w/o Antioxidant | 36.47 | 31.30 |

Perhaps a better method to investigate stability of vegetable oils in hydraulic systems is the use of the ASTM D2271 hydraulic pump test. This is a time consuming (1000-hour) and expensive test which helps determine both the wear protection as well as the stability of the test oil. In this test the stability of the test oil is determined by changes in its viscosity during the test. Until this investigation, the literature has for the most part written off soybean oil for use in hydraulic systems.

Thousands of hours of bench testing of treated and untreated soybean oils and other vegetable oils were performed. Table 1 shows a comparison of several vegetable oils including a number of soybean oils as tested in the ASTM D2271 test in our facility.

TABLE 1

Using ASTM 2271 1000-hour 79° C. pump tests to determine stability of various vegetable oils in hydraulic systems

| Item | | Viscosity | | |
|---|---|---|---|---|
| # | Oil Type/Description | Initial | Final | % Change |
| 1 | Palm Oil | 41.78 | 54.75 | 31.0 |
| 2 | Cotton Oil | 37.94 | 56.23 | 48.2 |
| 3 | High Oleic Canola Oil (1) | 38.20 | 57.73 | 51.1 |
| 4 | High Oleid Canola Oil (2) | 39.50 | 56.70 | 43.5 |
| 5 | High Oleic Sunflower Oil | 37.83 | 53.87 | 42.4 |
| 6 | Ultra High Oleic Sunflower Oil | 40.46 | 56.69 | 40.1 |
| 7 | Crude Soy Oil (Hexane extracted) | 29.91 | 73.77 | 146.6 |
| 8 | Crude Soybean Oil (expelled) | 30.16 | 65.87 | 118.4 |
| 9 | Crude Soybean Oil (extruded/expelled) | 30.93 | 65.18 | 110.7 |
| 10 | Low Linolenic Crude Soybean Oil | 31.33 | 70.89 | 126.3 |
| 11* | Bleached Soybean Oil (ASTM 2882 - 100 hr test) | 29.63 | 31.65 | 6.8 |
| 12* | Refined Soybean Oil (ASTM 2882 - 100 hr test) | 29.72 | 31.99 | 7.6 |
| 13* | Deodorized Soybean Oil (ASTM 2882 - 100 hr test) | 29.59 | 31.34 | 5.9 |

(Note items 11, 12, and 13 are based on ASTM D2882 which is a 100-hour test at twice the pressure, extrapolating the viscosity change to 1000 hours indicates similar results as other soybean oils).

Some of the above oils were tested with off-the-shelf additive packages, available for petroleum or vegetable oils. Table 2 represents the results of a combination of crude soybean oils with two off-the-shelf additive packages.

TABLE 2

Using ASTM 2271 tests to determine stability of various vegetable oils plus additive packages in hydraulic systems

| Item | | Viscosity | | % |
|---|---|---|---|---|
| # | Oil Type 1 Description | Initial | Final | Change |
| 15 | Crude Soybean Oil (Hexane extracted) plus Additive #1 | 30.31 | 68.45 | 125.8 |
| 16 | Crude Soybean Oil + Additive #1 | 32.32 | 53.11 | 64.3 |
| 17 | Crude (WC) Soybean Oil plus Additive #5 | 39.06 | 47.87 | 22.6 |

The next effort was focused on chemical modification of soybean oil as a means of increasing its oxidative stability. This led to the identification of one of the most stable commercially available, chemically modified soybean oils. This oils is Cargill Inc.'s #110 PKS-WOO soybean oil which is partially hydrogenated. When combined with two antioxidants, citric acid and Tertiary Butylhydroquinone (TBHQ), the oil showed to perform significantly more stable than other soybean oils. In the preferred embodiment the level of TBHQ was 200 million and the level of citric acid ranged from 10 parts/million to 100 million. Furthermore, the oil is winterized in order to improve its flowability in cold temperatures. Table 3 show the performance results of the selected oil (henceforth the base-oil) in the ASTM 2271. When compared with test oil (item #8, Table 1), the chemically modified soybean oil showed almost 50 % improvement in its viscosity stability.

TABLE 3

The Selected Base-Oil

| Item | | Viscosity | | |
|---|---|---|---|---|
| # | Oil Type/Description | Initial | Final | % Change |
| 18 | Base Oil | 38.62 | 56.45 | 46.2 |

Once the optimal base-oil was identified, it was blended with various additive components and/or packages and tested as shown in Table 4.

TABLE 4

The Optimum Mixture of Base-Oil and Additive

| Item | | Viscosity | | % |
|---|---|---|---|---|
| # | Oil Type/Description | Initial | Final | Change |
| 19 | Base Oil + Additive #2 | 39.63 | 63.44 | 60.1 |
| 20 | Base Oil + Additive #3 | 33.48 | 56.99 | 70.2 |
| 21 | Base Oil + 5% Food Grade Additive #4 | 34.42 | 62.56 | 81.8 |
| 22 | Base Oil + 9% Food Grade Additive #4 | 35.81 | 63.85 | 78.3 |
| 23 | Base Oil + an additional 200 ppm TBHQ anti-oxidant | 41.57 | 80.94 | 94.7 |
| 24 | Base Oil + 15% Methyl Ester | 23.27 | 53.35 | 129.3 |
| 25 | Base Oil + 15% Methyl Ester + Additive #5 | 36.28 | 45.78 | 26.2 |
| 26 | Base Oil + Additive #5 | 44.66 | 46.71 | 4.6 |

The last test (Item #26, Table 4), along with visual observations, indicated that optimal results are achieved when the base-oil is blended with an additive possessing the following properties:

Physical Characteristics

| | |
|---|---|
| Pounds per U.S. Gallon @ 15.6° C. | 7.025 |
| Specific gravity @ 15.6° C. | 0.870 |
| Viscosity: | |
| SUS @ 77° F. | 965 |
| (cSt @ 25° C. | 208) |
| SUS @ 104° F. | 495 |
| (cSt @ 40° C. | 107) |
| SUS @ 212° F. | 89.2 |
| (cSt @ 100° C. | 17.8) |
| Pour Point | −40° C. |
| Flash Point | 180° C. PMCC |

Chemical Characteristics (Weight % of)

| | |
|---|---|
| Calcium | 0.21–0.27 |
| Phosphorus | 0.20–0.26 |
| Sulfur | 0.6 |
| Zinc | 0.42–0.52 |
| Boron | 0.03 |
| Nitrogen | 0.16 |

One proprietary additive possessing all of the foregoing properties is Additive #5, Lubrizol LZ9999.

The synergy of the additive, LZ9999, with the base soybean oil was evident, not only in the stability of the oil's viscosity, but also in the lack of any polymer presence on the test stand, the feel of the oil to the touch, and many other subtle improvements found through observation. The recognition of the synergy combined with an understanding that established test methods (used in literature) do not measure true performance of the vegetable oils in hydraulic system were essential in the development of this product. The established methods of evaluating the performance of hydraulic fluids are designed for petroleum-based products, and are not always indicative of true performance of the vegetable oil based products.

Once the finished product was identified, it was tested at a different test facility (John Deere Product Engineering Center) using a piston pump. Additionally, the oil was tested in a blended state—50/50 with petroleum hydraulic oil. Test results are shown in Table 5 indicates there was almost no difference in the change of viscosity in the test fluids during the comparative mechanical testing.

TABLE 5

Test Results of the Blends of the Finished Product and Petroleum-based Hydraulic Oil Plus Test Results in Tractor Piston Pump

| Item # | Oil Type/Description | Viscosity Initial | Viscosity Final | Viscosity % Change |
|---|---|---|---|---|
| 27 | Finished Product plus 50% Petroleum Hydraulic Oil (ASTM 2271) | 42.27 | 42.94 | 1.6 |
| 28 | Finished Product in piston pump (1000 hr cycled) John Deere Report #R94661 | Passed | | 2% |

At the conclusion of the various comparative analyses, it was determined that the additive manufactured by Lubrizol, LZ9999, provided superior results over all other combinations. Use of LZ9999 produced a synergy with the soybean oil, which enhanced the durability of the fluid. Additionally, the additive produced positive results in the areas of the fluid functionality, specifically producing a fluid with the performance specifications shown in Table 6 and Table 7:

TABLE 6

Performance Characteristics Of Base Oil With Additive

| | | | |
|---|---|---|---|
| Base Oil | %/wt | 70, Cargill #110 PKS-WOO soybean oil (or equiv.) | |
| Additive Package | %/wt | 30, Lubrizol #9999 (or equivalent.) | |
| Kinematic Viscosity | | | |
| @ 40° C., Min | CST | 41.4 | ASTM D445 |
| @ 40° C., Max | CST | 50.6 | ASTM D2422 |
| Shear Stability, Vis. Loss @ 100° C. | % | 5.0 | ASTM D3945 |
| Viscosity Index, Min | | 230 | ASTM D567 ASTM D2270 |
| Brookfield Viscosity | | | |
| @ −10° C. | cP | <=760 | ASTM D2983 |
| @ −20° C. | cP | <=2500 | |
| Pour Point, Max | ° C. | −25 | ASTM D97 |
| Rust Protection | P/F | Pass | ASTM D665A&B |
| Copper Corrosion | | 1a | ASTM D130 |
| Foaming Characteristics | | | |
| Sequence I Max | mL | <=110/0 | ASTM D892 |
| Sequence II Max | mL | <=5/0 | |
| Sequence III Max | mL | <=85/0 | |
| Foam Break Time Max | s | <=30/0 | |
| Water Sensitivity | | | |
| Solids | % Volume | <=0.1 | ASTM D4997 |
| Additive Loss | % Mass | 15.0 | |
| Color | | clear, light amber | |

TABLE 7

Specified Performance Properties Of Base Oil And Additive

| PERFORMANCE PROPERTY | SATISFACTORY TEST RESULTS REQUIRED SB46-IT | TEST METHOD |
|---|---|---|
| Vane Pumps/Motors | | |
| Wear/Corrosion | yes | Vickers V-104C |
| Flow Degradation | yes | ASTM 2882 w/1500 psi modified<br>ASTM 2271 (104C)<br>ASTM 2271 (20-VQ) |
| Piston Pump/John Deere AR 94661 | | 1000 hrs. 3 step cycle |
| Wear/Corrosion | yes | considered 6x normal |
| Flow Degradation | yes | Agri. Tractor Duty Cycle |

An OSI test of the various blends of the base oil and the selected additive was conducted to determine the optimum blend ratio for use in hydraulic application. While not as rigorous as the ASTM D2271, a test of the blend in OSI is included. Table 8 shows numbers for the base-oil/additive mixtures of 100-0 to 60-40 additive-base oil blends:

TABLE 8

Relationships Between Various Blends Of The Base-Oil And LZ9999 And Oxidative Stability In OSI

| % Additive | % Base-Oil | OSI (hours) |
|---|---|---|
| 100 | 0 | 31.50 |
| 95 | 5 | 28.65 |
| 90 | 10 | 55.55 |
| 85 | 15 | 76.50 |
| 80 | 20 | 80.95 |
| 75 | 25 | 107.30 |
| 70 | 30 | 129.25 |
| 65 | 35 | 152.80 |
| 60 | 40 | 191.75 |

Figure 3:
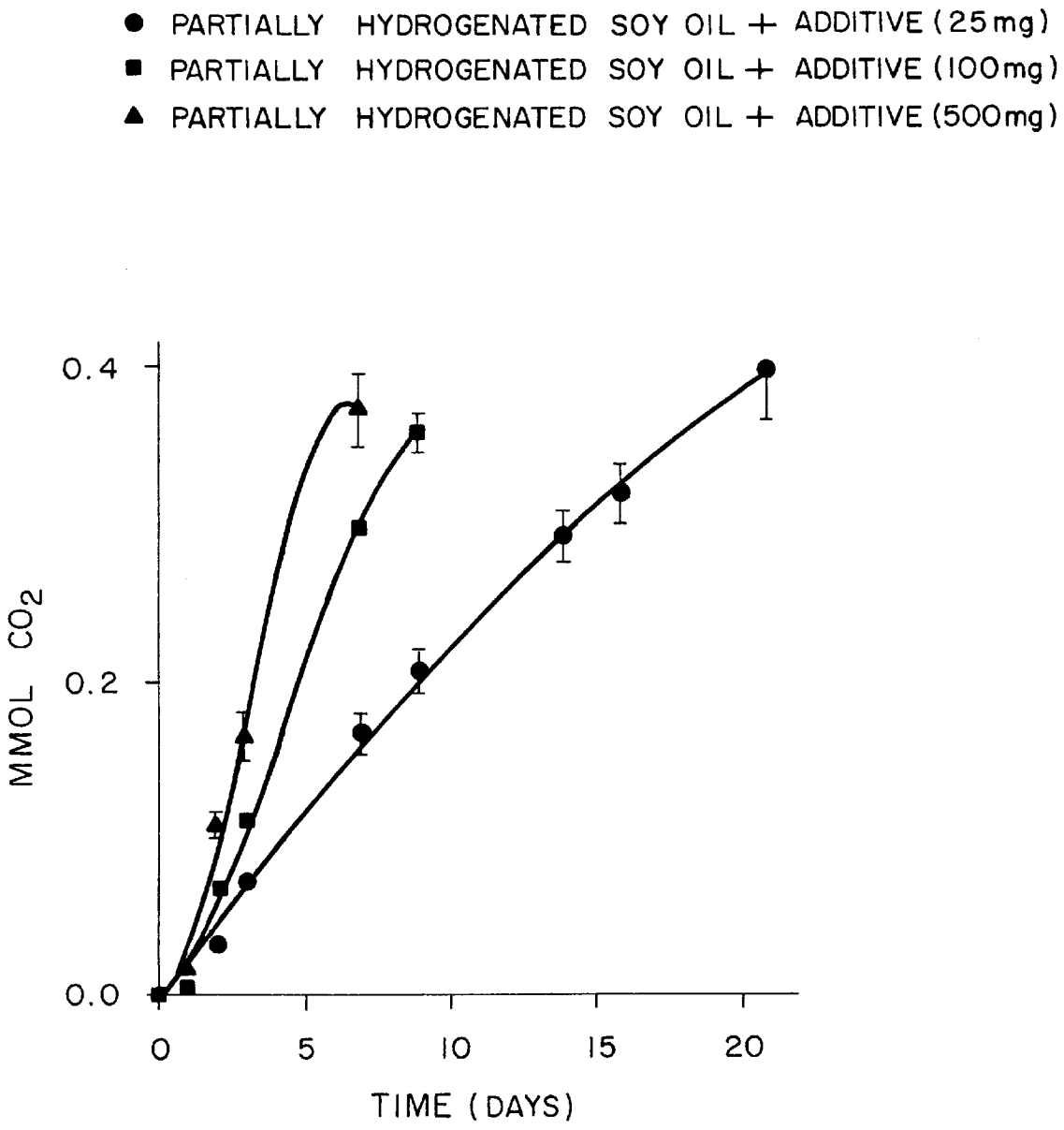
FIG. 3 is a graphic representation showing the comparative biodegradation characteristics of the base soybean oil containing varying levels of chemical lubricant additive.
Figure 4:
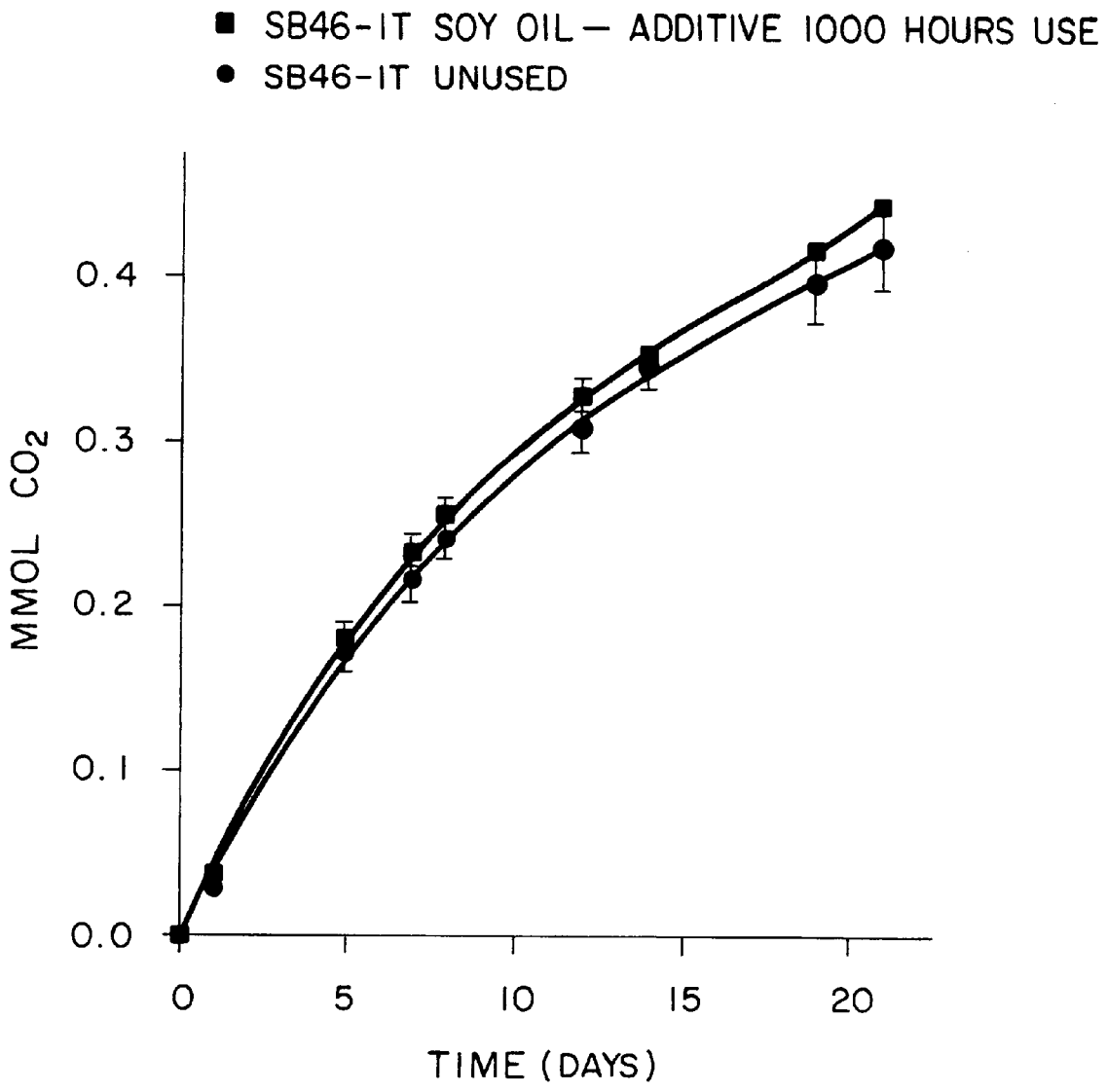
FIG. 4 is a graphic representation comparing the biodegradation qualities of the base soybean oil combined with the chemical lubricant additive in a used state and an unused state.
Figure 5:
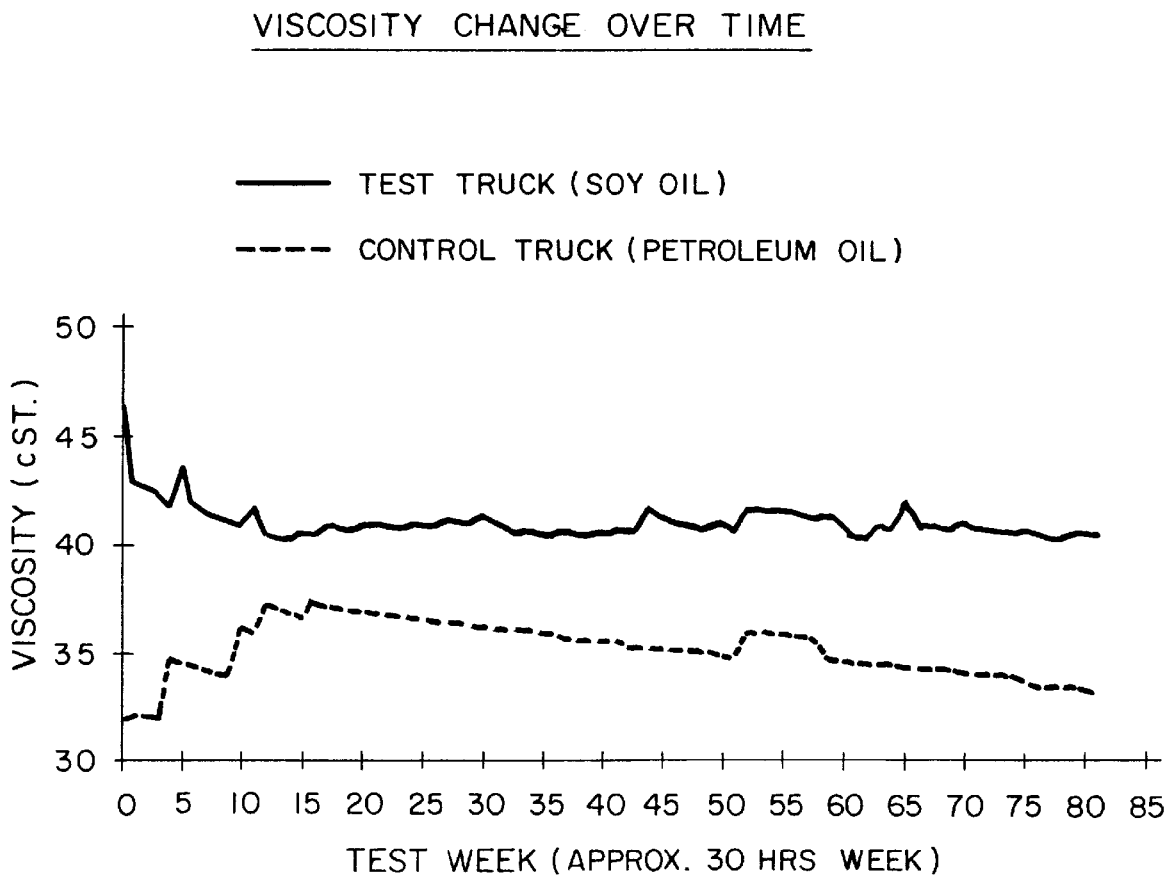
FIG. 5 is a graphic representation of viscosity change over time comparing the impact of field use of petroleum-based hydraulic fluids versus the soybean oil-based hydraulic fluid containing the chemical lubricant additive.

Additional testing of the oil included biodegradability tests to determine the biodegradation of the mixture (fresh and after use in 1000-hour hydraulic pump test) in soil using CO2 evolution in given number of days. FIGS. 3, 4 and 5 shows the results of these tests.

Field Test Results

Several field tests of the invention were conducted in which observations of tests done in the laboratory were verified. These field test results indicated that in terms of oxidative stability, as derived from observing changes in viscosity, the oil performs similarly in the field although at a much slower rate of degradation than those observed in the laboratory.

In excess of 25 pieces of mobile equipment operational at five different sites were equipped with the finished product for thorough observation and monitoring. The sites included two grain elevators using the oil in their railcar-movers, a garbage truck, a front-end loader, and a city Public Works facility. All sites were located in Iowa. Also, 20 pieces of mobile equipment were equipped with the soybean oil based hydraulic fluid at Sandia National Laboratories, Albuquerque, N. Mex. Tests results confirmed that the finished product performed as it did in the ASTM D2771 (1000-hour) test with degradative changes being at a slower rate than was evidenced in the laboratory tests.

Activities at one field test site included the observation of oil sample on weekly basis by three laboratories to monitor the changes in the Fatty Acid Profile, Elemental Analysis, Total Acid Number, and Viscosity. Furthermore, the test truck was monitored along with a control truck containing a petroleum-based hydraulic fluid. The test is continuing, but results to date indicate positive performance with no sign of degradation. FIG. 6 shows the viscosity curves of both trucks over many weeks of operation.

From the foregoing, it will be evident that the invention provides an improved non-petroleum based, environmentally safe hydraulic fluid that can be commercially used in the hydraulic systems of mobile outdoor equipment that is operated under widely varying conditions. The hydraulic fluid of the invention utilizes soybean oil in which the soybean oil is less than 85% by weight. The additive package used in the invention contains materials specifically designed for mobile equipment application including friction and anti-chatter materials, needed for wet clutches and brakes. The combination of the specific soybean oil and the additive has produced a hydraulic fluid that withstands the rigors of field use involving a wide range of temperatures. The preparation of the soybean-oil based hydraulic fluid of the invention does not involve any heating as required in some of the prior art references. Furthermore, the hydraulic fluid of the invention has been designed to maintain a stable viscosity at a lower range of viscosity than those designed for possible use with telomerized additives; which are often for high viscosity lubricants. The soybean oil based hydraulic fluid of the present invention is produced using an additional step of winterization to remove crystallized fats and improve the pour point of the base oil.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A process for producing a soybean-based hydraulic fluid comprising: partially hydrogenizing crude soybean oil to stabilize the oil; winterizing the stabilized soybean oil to remove crystallized fats; and combining the soybean oil with a chemical lubricant additive to produce a hydraulic fluid having a kinematic viscosity in the range of 40–51 cSt @ 40° C.

2. The process of claim for producing a soybean oil based hydraulic fluid in which the soybean oil is less than 85% by weight.

3. The process of claim 2 for producing a soybean oil based hydraulic fluid in which the soybean oil is about 70% by weight and the chemical lubricant additive is about 30% by weight.

4. The process of claim 3 for producing a soybean oil based hydraulic fluid in which the fatty acid profile of the hydraulic fluid includes about 0.12% C24:0.

5. The process of claim 3 for producing a soybean oil based hydraulic fluid in which the chemical lubricant additive has the following physical characteristics:

| | |
|---|---|
| Pounds per U.S. Gallon @ 15.6° C. | 7.025 |
| Specific gravity @ 15.6° C. | 0.870 |
| Viscosity: | |
| SUS @ 77° F. | 965 |
| (cSt @ 25° C. | 208) |
| SUS @ 104° F. | 495 |
| (cSt @ 40° C. | 107) |
| SUS @ 212° F. | 89.2 |
| (cSt @ 100° C. | 17.8) |
| Pour Point | −40° C. |
| Flash Foint | 180° C. PMCC |

6. The process of claim 3 for producing a soybean oil based hydraulic fluid in which the chemical lubricant additive has the following chemical characteristics by percentage of weight:

| | |
|---|---|
| Calcium | 0.21–0.27 |
| Phosphorus | 0.20–0.26 |
| Sulfur | 0.6 |
| Zinc | 0.42–0.52 |
| Boron | 0.03 |
| Nitrogen | 0.16 |

7. A soybean oil based hydraulic fluid produced by the process of claim 1 comprised of about 70% by weight soybean oil and about 30% by weight hydrocarbon based performance additive.

8. A soybean oil based hydraulic fluid of claim 7 wherein the soybean oil contains the following antioxidants: about 25 to about 50 parts per million of citric acid and about 200 parts per million of Tertiary Butylhydraquinone.

9. A soybean oil based hydraulic fluid of claim 8 wherein the soybean oil contains a hydrocarbon based performance additive having the following physical characteristics:

| | |
|---|---|
| Pounds per U.S. Gallon @ 15.6° C. | 7.025 |
| Specific gravity @ 15.6° C. | 0.870 |
| Viscosity: | |
| SUS @ 77° F. | 965 |
| (cSt @ 25° C. | 208) |
| SUS @ 104° F. | 495 |
| (cSt @ 40° C. | 107) |
| SUS @212° F. | 89.2 |
| (cSt @ 100° C. | 17.8) |
| Pour Point | −40° C. |
| Flash Point | 180° C. PMCC |

10. A soybean oil based hydraulic fluid of claim 9 wherein the soybean oil contains a hydrocarbon based performance additive having the following chemical characteristics by percentage of weight:

| | |
|---|---|
| Calcium | 0.21–0.27 |
| Phosphorus | 0.20–0.26 |
| Sulfur | 0.6 |
| Zinc | 0.42–0.52 |
| Boron | 0.03 |
| Nitrogen | 0.16 |

* * * * *